United States Patent [19]

Betkouski

[11] 4,238,943

[45] Dec. 16, 1980

[54] DEAD BOLT LOCK ACCESSORY

[76] Inventor: Mathew F. Betkouski, 5132 Whitsett Ave., North Hollywood, Calif. 91607

[21] Appl. No.: 38,785

[22] Filed: May 14, 1979

[51] Int. Cl.[3] ..... E05B 13/00

[52] U.S. Cl. ..... 70/416; 70/431

[58] Field of Search ..... 70/416, 431, 447

[56] References Cited

U.S. PATENT DOCUMENTS 4,064,721 12/1977 Morgan ..... 70/416

*Primary Examiner*—Robert L. Wolfe

*Attorney, Agent, or Firm*—Arthur G. Yeager

[57] ABSTRACT

A device for mounting on the inside of doors employing a dead bolt lock to cause the lock to be opened from the outside with a key but only after turning the key to the right and to the left a given number of times. The advantage of this device is to provide a selected time delay in unlocking the door.

11 Claims, 5 Drawing Figures

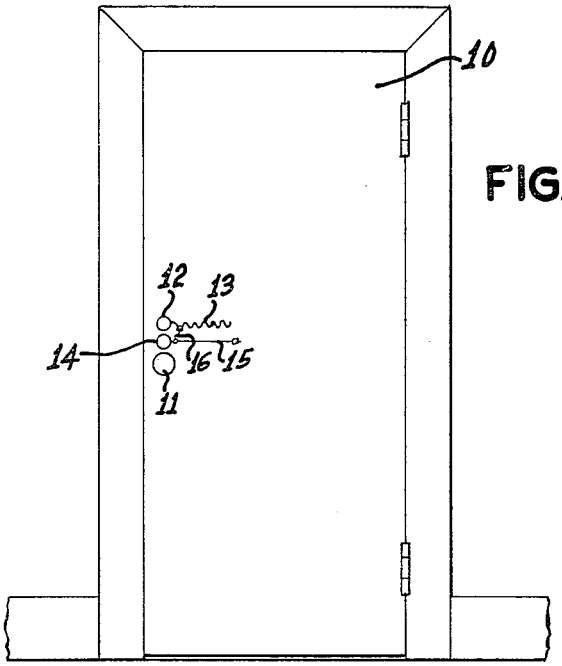
FIG. 1
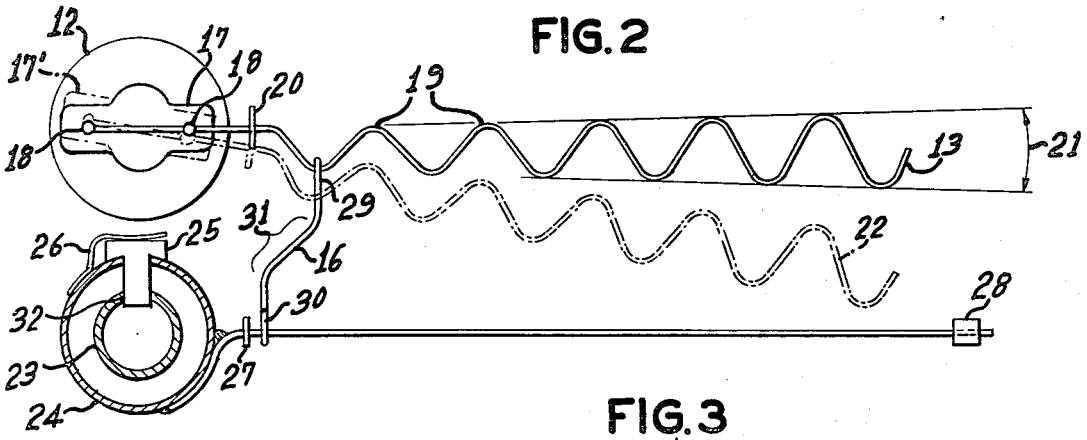
FIG. 2
FIG. 3
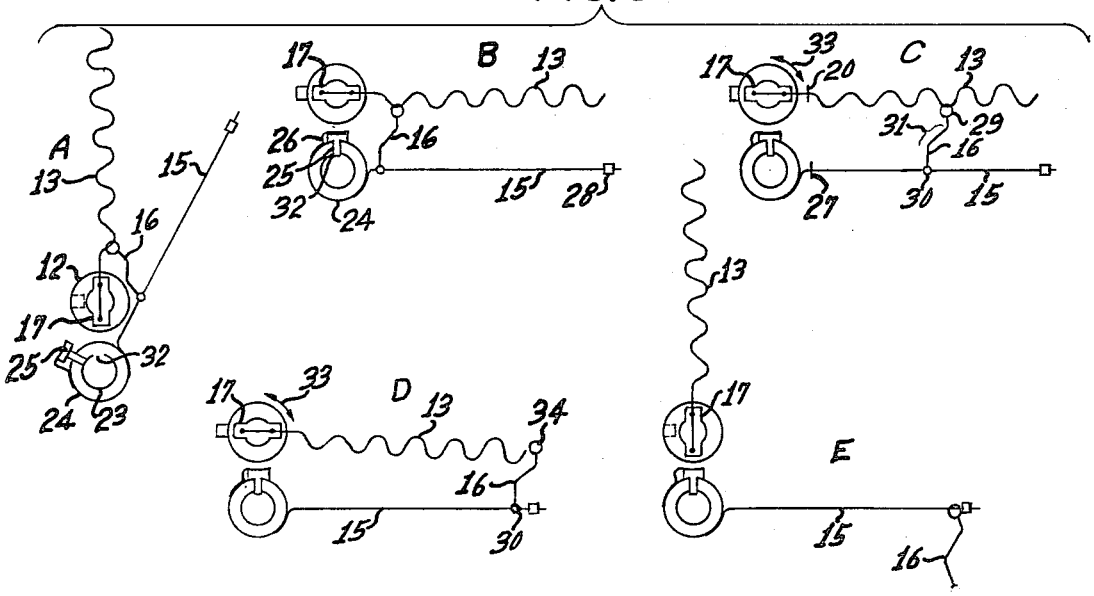

DEAD BOLT LOCK ACCESSORY

BACKGROUND OF THE INVENTION

Many residences include on the outside doors a dead bolt lock as an additional safeguard against illegal entry by burglars. These locks are nothing more than a large bolt which is square on its end and which can be moved horizontally into a receiving hole in the door fame by means of manual lever on the inside of the door or by a key on the outside of the door. The bolt cannot be moved by inserting a thin plate or card between the door and the door frame to cause the bolt to recede to its unlocked position as can be done with the usual door latch having a angular face to the latch. The dead bolt lock must be moved by means of a key or a lock pick if the door is reasonably fitted to the frame. Lock picks of various types are commonly used by burglars, and those with experience can rapidly open dead bolt locks with such devices. Furthermore, with the proliferation of the keys one can expect many burglars to have keys for many dead bolt locks.

It is an object of this invention to provide an accessory to be used in connection with dead bolt locks that will cause considerable delay in opening such locks even though a proper key is used. Any delay would discourage a burglar because it increases the chance of being discovered in attempting an illegal entry.

The novel features believed to be characteristic of this invention are set forth with particularity in the appended claims. The invention itself, however, both as to its organization, and method of operation, together with further objects and advantages thereof may thus be understood by reference to the attached drawings and to the following description.

BRIEF SUMMARY OF THE INVENTION

This invention comprises a dead bolt lock accessory which is mounted on a vertical surface such as a door and serves as a safeguard against tampering. The accessory comprises (1) a first elongated arm attached to the inside manually operated handle of the dead bolt lock, the arm containing a series of regularly spaced, vertically upward projections of substantially the same shape and of increasing vertical length as the distance from the axis of rotation of the arm increases; (2) mounted vertically above or below said dead bolt handle affixed post and a collar rotatably attached to the post carrying a spring biased radially slideable pin which is capable of engaging a hole in the fixed post, the collar having fixed to it a second elongated arm substantially the same length as the first elongated arm and positioned in vertical alignment with the first arm, the second elongated arm having a smooth level surface, a constant cross section, if necessary a weighted portion at its free end; and (3) a linking member slidably attached to both the first and second elongated arms by a first and second eye, respectively, the first eye having a vertical length at least as large as the vertical length of the largest projection on the first elongated arm, and the second eye being slightly larger than and loosely slideable over said second elongated arm, the connection between the first and second eyes being offset such that the first eye is more distant than the second eye from the centerline of the dead bolt.

In the specific embodiments of this invention the two elongated arms preferably both lie in a plane substantially parallel to the surface on which the accessory is mounted; or the two arms are formed into substantially identical curves. In other embodiments the projections on the first elongated arm are a series of sine waves or a series of tooth-like projection on one side of the arm with a smooth level surface on the other side of the arm. There may be from 5 to 100 projections on the first elongated arm and it is positioned vertically above on the second elongated arm. On most applications of this invention 10–25 projections will be sufficient on the first elongated arm.

BRIEF DESCRIPTION OF THE DRAWINGS

FIG. 1 is a view of a door having the device of this invention mounted on it.

FIG. 2 is an enlarged view of the device of this invention.

FIG. 3 is a series of schematic illustration showing the operation of the device of this invention.

DETAILED DESCRIPTION OF THE INVENTION

Figure 4:
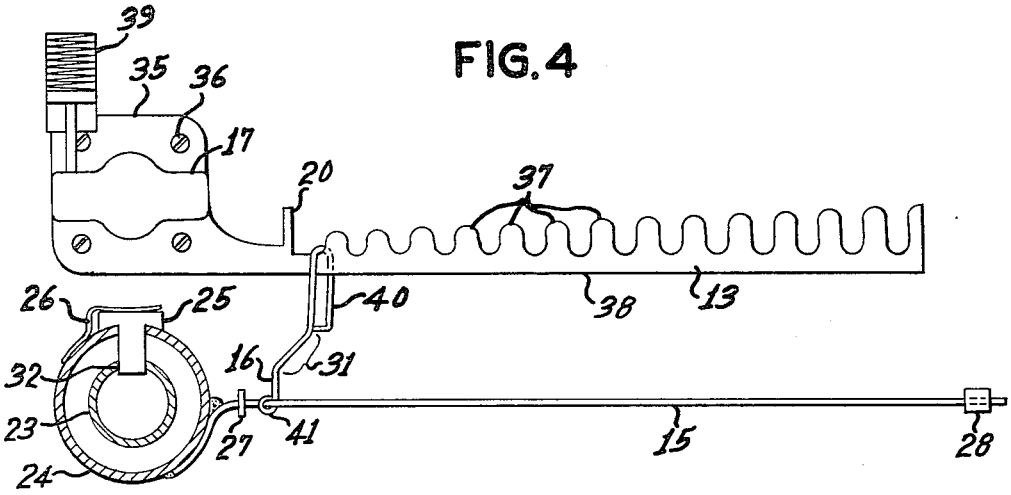
FIG. 4 is an enlarged view of the device of this invention in which the upper arm is made from a structurally strong sheet of material.

With specific reference FIGS. 1, 2, and 3 the details of the device and operation of this invention may be understood. The normal use for this invention is in connection with a dead bolt lock on a door to a home, office, hotel room, motel room, or the like. Door 10 is shown in FIG. 1 having door knob 11 and dead bolt lock 12. Attached to lock 12 is first elongated arm 13. Support 14 is attached to door 10 immediately below lock 12 and it carries second elongated arm 15. Arms 13 and 15 are connected to each other by link member 16.

In FIG. 2 there is shown the portion of dead bolt lock 12 which is on the inside of a door. Manually operated handle 17 is attached at 18 by any suitable means, such as screws, soldering, etc. to first elongated arm 13. In this embodiment of the invention arm 13 is made from metal wire or rod bent into a sine wave. The linear horizontal distance from each projection 19 to the next adjacent projection 19 increases as the distance from the axis of rotation of the dead bolt lock 12 increases. This increasing height of projection 19 shows itself in the form of a taper 21, which for most practical purposes of this invention is from about 1° to about 5°, preferably about 1°–3°. At the inner end of arm 13 is stop 20 which is merely a cross piece sufficiently large to prevent link member 16 from sliding any farther toward handle 17 than the position of stop 20.

Mounted immediately below dead bolt lock 12 is fixed post 23 which is firmly attached to door 10 by any convenient means, such as a mounting plate and screws (method of attachment not shown on drawings). Rotating about fixed post 23 is collar 24 to which is attached pin 25 which is pressed inwardly by means of spring 26. Pin 25 slides radially with respect to a hole in collar 24 and permits rotation of collar 24 when not engaged in hole 32 in fixed post 23. When pin 25 is in the position shown in this drawing collar 24 is locked into an immovable position, but when pin 25 is pulled outwardly against spring 26 and is released from hole, 32, collar 24, pin 25 and spring 26 are free to rotate about post 23. Attached to collar 24 by soldering or other convenient means is second elongated arm 15 which is, in the embodiment shown in the drawing, a smooth straight wire or rod positioned in a generally horizontal direction and vertically below elongated arm 13. Arm 15 has stop 27 which serves the purpose of preventing eye 30 and link member 16 from moving any closer to collar 24 than is permitted by stop 27. At the outer extremity of arm 15 there may be a small weight 28, the function which will be described below. It will be appreciated that post 23, collar 24, pin 25, and spring 26 could be suitably made a part of handle 11 (see FIG. 1) is so desired.

The only connection between arms 13 and 15 is link member 16 which, in the embodiment of this drawing, is a piece of wire or rod of substantially the same size as that employed for arms 13 and 15. Link member 16 is fashioned with an eye at each of its extremities, first eye 29 being attached to arm 13 and second eye 30 being attached to arm 15. First eye 29 should be sufficiently long in a vertical direction to be slightly larger than the vertical length of the largest of projections 19. Second eye 30 should be relatively small in size, loosely fitting over arm 15 so as to provide no resistance to sliding but the internal diameter of loop 30 should not be more than about 1.2 times the diameter of arm 15 for the preferred operation of this invention. The vertical distance between eyes 29 and 30 is determined by the vertical distance between arms 13 and 15 which will permit link member 16 to function in the described manner.

In FIG. 3 there is shown the operation of this invention. In A the device is in position for the door to be closed and locked from the outside. Dead bolt lock handle has been turned so that the bolt is completely withdrawn into the door with the arm 13 in a vertical position link member 16 resting against stop 20, and arm 15 at an angle to the vertical determined by its connection to link member 16. In order for arm 15 to be in this position pin 25 must have been disengaged from hole 32 in post 23. The door is then closed and a key inserted into lock 12 and turned so as to engage the bolt in a locking position. This causes handle 17 and arm 13 to move to the horizontal position. Arm 15 moves to the horizontal at the same time because its own weight or weight 28 pulls it down to that position by the force of gravity. When arm 15 reaches the horizontal position pin 25 snaps into hole 32 locking collar 24 and arm 15 in a fixed position. In order to unlock this assembly with a key from the outside the key must be turned to the right and to the left as shown by direction arrow 33 in C causing arm 13 to undergo those same movements which are transmitted to link 16. This is shown, for example, in FIG. 2 by the dotted line position 22 of arm 13 and a corresponding position 17' of handle 17. The fixed position of arm 15 restricts the amount of movement of arm 13 and of the key in the lock although there is sufficient play in the components to permit some movement of the key and of arm 13. This movement of the key causes link member 16 to move outwardly along arm 13, one projection at a time. This is accomplished by reason of the offset 31 in link 16 wherein the first eye 29 is farther removed from stop 20 than second eye 30 is removed from stop 27. When the key is turned so as to cause arm 13 to move upwardly eye 30 swings to the right because offset 31 has shifted the center of gravity to the right. When the key is turned to cause arm 13 to move downwardly the weight of link member 16 rests on arm 15 and eye 29 is free to move. Because of offset 31 link member 16 tends to fall to the right which causes eye 29 to pass over the first projection and fall against the second projection. When the key is again turned to cause arm 13 to move upwardly link member 16 is suspended from arm 13 at eye 29 which slides to the lowest point between the first and second projections. As soon as arm 13 has moved enough to release the weight of link 16 from arm 15 the center of gravity of link 16 causes it to swing such that eye 30 again moves to the right. When the key is turned again so that arm 13 moves downwardly the previous process is repeated and eye 29 moves over the second projection and falls against the third projection. In this fashion with each movement of the key link member 16 walks from left to right projection-b-projection toward the end of arm 13. In D link 16 has reached end 34 of arm 13 and will fall to the right to disengage the connection between arms 13 and 15. When this happens link member 16 will be supported soledly by arm 15 as shown in view E and the key in the lock is free to turn as far as is necessary in order to withdraw the bolt and unlock the door.

In FIG. 4 there is shown a device of this invention which follows the same principles as those just described but which is constructed differently so as to provide a stronger device. In this embodiment arm 13 is not a wire or rod but is cut from a sheet or plate by machining the tooth-like projections 37 with the bottom edge 38 of arm 13 being substantially straight. The actual configuration of these teeth may be more or less pointed or more or less rounded so long as the horizontal distance between projections is substantially constant and that they increase slightly in length as the distance from the axis of rotation of the dead bolt increases. First eye 40 is substantially as long vertically as the largest of projections 37, i.e. the one farthest to the right; and second eye 41 is only slightly larger than the diameter of arm 15. Because this embodiment provides greater weight it is more difficult to move it by means of a key outside the door. Furthermore this device is not as easily attached to the handle 17 as is the case with a wire arrangement as is shown in FIG. 2. In the present embodiment arm 13 is machined from a sheet which includes any convenient method of attaching the arm to handle 17. In this drawing a backing plate (not shown) is attached to handle 17 and arm 13 is attached through mounting plate 35 by means of screws 36 to the backing plate. This causes arm 13 to move with any movement of handle 17. Because the mass and length of arm 13 will tend to provide a clockwise torque, spring 39 or any other alternative counterbalance means is preferably attached to the door upon which this device is attached and be biased against the opposite side of handle 17 from which the weight of arm 13 is suspended. This provides some assistance in moving arm 13 in a counterclockwise direction with the key, and it also prevents arm 13 from freely turning in a clockwise direction which would eliminate some of the positive movements of the key which this invention provides as a delay in unlocking the door.

Figure 5:
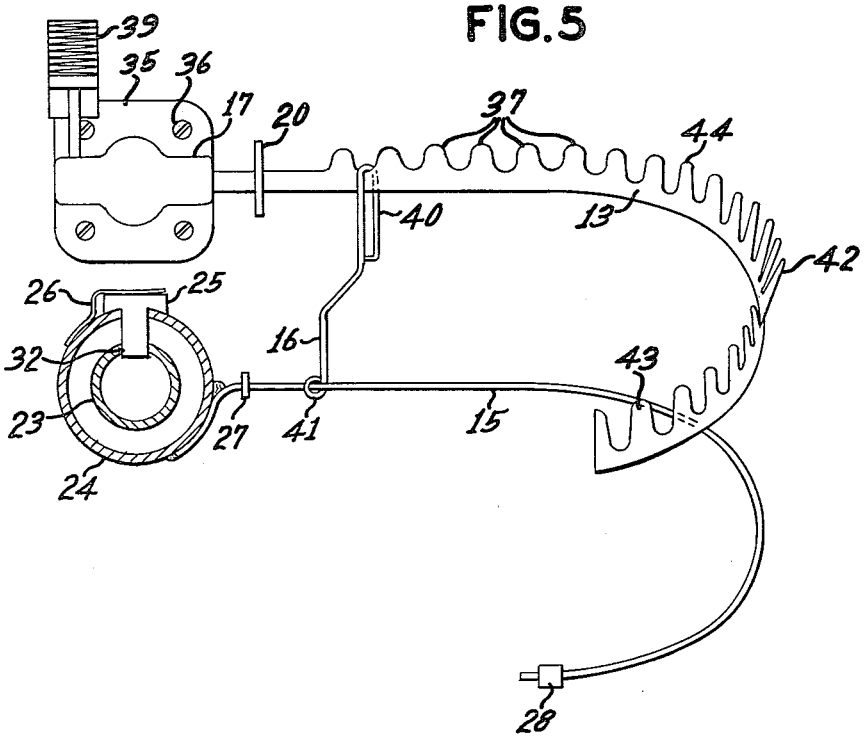
FIG. 5 is a view of a device similar to that shown in FIG. 4 except that it provides much longer travel and is made in a curved configuration.

In FIG. 5 there is shown a device similar to that of FIG. 4 except that arms 13 and 15 are bent into a curve. These two arms may be bent into almost any shape which does not have sharp angles so long as both of the arms are bent into the exactly the same shape with arm 15 preferably lying vertically below arm 13. Such a configuration serves two purposes. In the first place this permits many more projections 37 to be employed within the space of a residential door. This curve can actually be continued to form a spiral with a very large number of projections 37 included therein. In the second place this reduces forces needed to turn the key in the lock because, even though the weight may be greater, the distance from the pivot at the center of handle 17 is reduced and thus the overall torque is kept to a minimum. It is not necessary that arm 13 be higher in elevation than arm 15. These may be reversed or inverted and the principles of this invention will still apply although it may be necessary to reverse the offset 31 of link member 16. In the device of FIG. 5, first eye 40 is as long vertically as the largest of projections 37 and the second eye 41 is slightly larger than the diameter of arm 15. The size of projections 37 increases with the distance from the axis of rotation of handle 17. Thus projections 42 are larger than projections 43 or 44.

While the invention is described with respect to certain specific embodiments, it will be appreciated that many modifications and changes may be made by those skilled in the art without departing from the spirit of the invention. It is intended, therefore, by the appended claims to cover all such modifications and changes that fall within the true scope of this invention.

What is claimed as new and what is desired to secure by Letters Patent of the United States is:

1. A dead bolt lock accessory for mounting on vertical surface to function a time delay in unlocking the lock comprising (1) a first elongated arm attached to the inside manually operated handle of a dead bolt lock, the arm containing a series of regularly spaced vertically upward projections of increasing vertical length as distance from the axis of rotation of said handle increases, (2) mounted vertically above or below said dead bolt handle a fixed post and a collar rotatably attached to said post, said collar carrying a spring biased radially slideable pin which is capable of engaging a hole in said fixed post, said collar having fixed to it a second elongated arm substantially the same length as said first elongated arm and positioned in vertical alignment with said first elongated arm, said second elongated arm having a smooth level surface, a constant cross section, and a weighted portion at its free end; and (3) a linking member slideably attached to both the first and second elongated arms by a first and second eye, respectively, said first eye having a vertical length at least as large as the vertical length of the largest of said projections and said second eye being slightly larger than and loosely slideable over said second elongated arm, the connection between said first and second eyes being offset such that said first eye is more distant from said axis of rotation than the second eye is from the axis of said post.

2. The dead bolt lock accessory of claim 1 in which said first and second elongated arms both lie in a plane substantially parallel to the vertical surface on which the accessory is mounted.

3. The dead bolt accessory of claim 1 in which the vertical projections of said first and second elongated arms are substantially identical curves.

4. The dead bolt accessory of claim 3 in which said curves are spiral.

5. The dead bolt accessory of claim 1 in which said first elongated arm is a rod bent into the form of a series of sine waves.

6. The dead bolt accessory of claim 1 in which said first elongated arm is a strip with a series of tooth-like projections on the side farther away from said second elongated arm and a smooth level surface on the side closer to said second elongated arm.

7. The dead bolt accessory of claim 1 in which each of said projections on said first elongated arm is longer in length than the next adjacent projection which is closer to the axis of rotation of said dead bolt handle, the increase of length in successive projections being equivalent to a taper of 1°–5°.

8. The dead bolt lock accessory of claim 1 wherein the weight of said first elongated arm is at least partially counterbalanced.

9. The dead bolt lock accessory of claim 1 in which the number of said projections on said first elongated arm is from 5 to 100.

10. The dead bolt lock accessory of claim 1 in which said first elongated arm is positioned vertically above said second elongated arm.

11. Accessory means for a dead bolt slideably mounted on a door provided with an external activating mechanism and an interior handle connected to and moveable with said mechanism, said means comprising an interiorly disposed restraining element fixed to said door, a restrained element fixed to said handle, one of said elements constituting an escapement element, and a link disposable on said elements and moveable progressively therealong in response to repeated restricted relative movements between said elements.

* * * * *